US005405467A

United States Patent [19]

Young et al.

[11] Patent Number: 5,405,467

[45] Date of Patent: Apr. 11, 1995

[54] RUBBER RIVETING OF MOLDED PARTS

[75] Inventors: Kenneth D. Young; Stephen P. Simons, both of Kingwood, Tex.

[73] Assignee: Hydril Company, Houston, Tex.

[21] Appl. No.: 104,371

[22] Filed: Aug. 9, 1993

[51] Int. Cl.[6] ..... B32B 7/08; E21B 33/06

[52] U.S. Cl. ..... 156/91; 156/85; 156/92; 251/1.3; 264/273; 264/274

[58] Field of Search ..... 156/91, 92, 85, 293; 251/1.3; 264/274, 273, 263, 230, 342 R; 277/235 R

[56] References Cited

U.S. PATENT DOCUMENTS

| | | | |
|---|---|---|---|
| 2,604,903 | 7/1952 | Neilon | 251/1.3 |
| 3,086,517 | 4/1963 | Dunkle | 156/91 |
| 3,132,412 | 5/1964 | Kreissig | 264/274 |
| 4,456,215 | 6/1984 | Bishop | 251/1.3 |
| 4,541,639 | 9/1985 | Williams | 251/1.3 |
| 4,684,418 | 8/1987 | Kleykamp | 156/91 |
| 4,858,882 | 8/1989 | Beard et al. . | |
| 5,160,474 | 11/1992 | Huff | 264/274 |
| 5,180,137 | 1/1993 | Carlson et al. | 251/1.3 |
| 5,195,581 | 3/1993 | Puntambekar | 156/91 |

OTHER PUBLICATIONS

Machinery's Handbook, 23rd Edition, Edited by Henry H. Ryffel, Industrial Press, Inc., New York, N.Y., 1988, pp. 1259–1276.

*Primary Examiner*—Michael W. Ball
*Assistant Examiner*—Daniel J. Stemmer
*Attorney, Agent, or Firm*—Vaden, Eickenroht, Thompson, Boulware & Feather

[57] ABSTRACT

A combination of a rubber or other elastomer part and a plastic or metal part is bonded by both chemical and mechanical means. The mechanical means is in the form of molded rivets integrally manufactured in the molding process as part of the elastomer. Appropriate mating holes are made in the plastic or metal parts to receive the rivets during the molding process or at least before the rivets are cured. Conventional chemical bonding materials for the circumstance are employed with the rivet bonding to provide dual bonding strength. The parts of a blowout preventer, such as at the T-seal and the upper seal, are disclosed as preferred examples of locations that are subject to high pressure and temperature where an elastomer part is bonded to a plastic or a metal part.

2 Claims, 3 Drawing Sheets

FIG.1
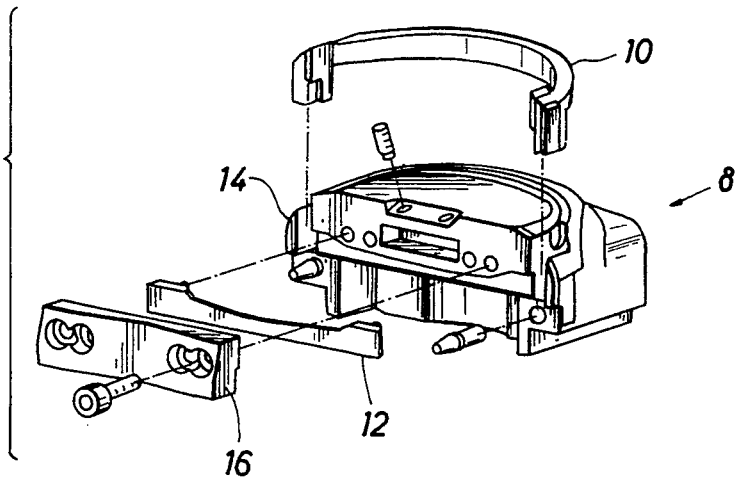
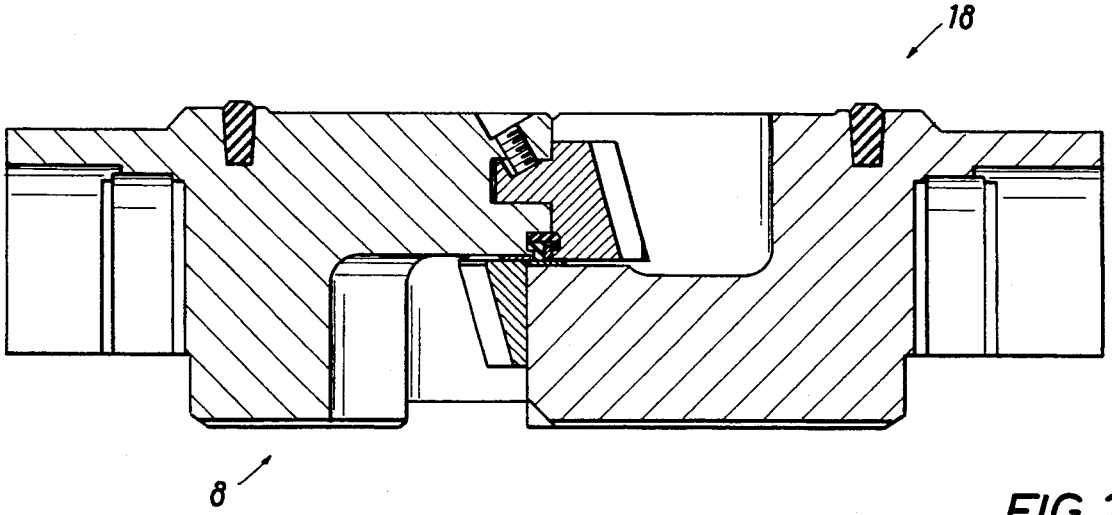
FIG.2
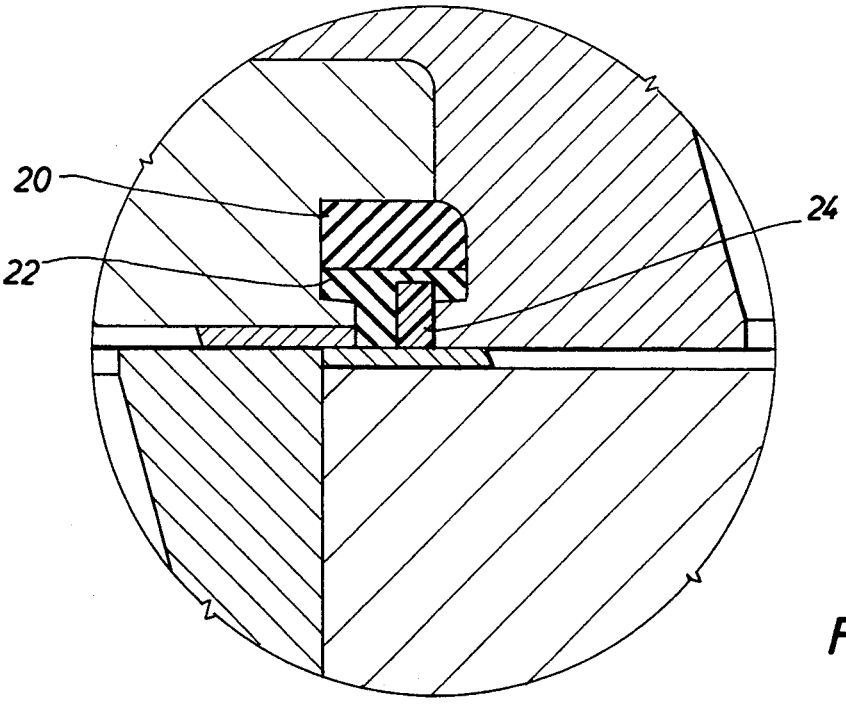
FIG.3

RUBBER RIVETING OF MOLDED PARTS

BACKGROUND OF THE INVENTION

1. Field of the Invention

This invention pertains to the bonding together of high performance parts, one of which is rubber or other elastomer and the other part being plastic or metal and more particularly to the bonding together of such parts that are part of a well head blowout preventer.

2. Description of the Prior Art

There are chemical bonding materials that are considered to be high performing in applications where an elastomer, typically rubber, is bonded or adhered to a dissimilar material, such as plastic or metal. One such application is in blowout preventers where the packer for closing off the annulus of a well, sometimes under emergency conditions, is made up of a combination of elastomer and plastic and/or metal parts. Typically, the packer either closes around a well pipe extending through the central bore or opening of the blowout preventer, or packer assemblies close together after the well pipe is sheared off.

The bonding of parts is necessary to prevent the elastomer parts from separating from the dissimilar material parts when subjected to extremely high pressures (e.g., 10,000 to 20,000 psi) or extremely high pressures and temperatures (e.g., 180° F. to 400° F.). A slight separation becomes a problem in the overall operation in two main ways. First, a slightly separated part changes the dimensioning of the assembly of parts, which dimensional change can interfere with normal operation and can cause the interfering part to be cut off when operation forces the closing or opening of other parts of the assembly. Thus, a separated elastomer part that is supposed to seal is often cut off so that it no longer adequately seals in the intended manner. Secondly, separation of assembly parts, one of which is an elastomer that readily "flows" when subjected to extremely high pressures or high pressure and high temperatures, creates "gaps" and permits the extrusion of the elastomer between adjacent metal pieces where the metal-to-metal contact or fit is less than perfect. High pressures tend to extrude the elastomer through small gaps. High temperatures cause the elastomer to become soft, so when present together, elastomers extrude rather easily. Extrusion of the elastomer can result in both high pressure and low pressure leaks and other harmful conditions, which, if bad enough can result in premature wear-out of parts and even in creating dangerous operating conditions.

Even the toughest metal/plastic-to-elastomer bonding materials can fail under adverse conditions. First, the bonding material between metal or plastic and an elastomer is usually the weakest structural link of the assembly. Second, the composition material itself can degrade and either become soft or brittle. If it becomes soft, then the bonding material can itself extrude away from the bonding surface under high pressure conditions. If the material cracks, then it no longer is an acceptable bonding material. Third, however, and perhaps more importantly since bonding materials are known that exhibit reasonably stable properties even under extremely high pressures and temperatures, the interface surfaces of rubber and metal or rubber and plastic do not exhibit the same dimensional stability as each other under high pressure and high temperature conditions. That is, one surface will expand more than the other, thereby causing breakaway from the bonding material, especially after repeatedly being subjected to normal and then high pressure and high temperature conditions.

Thus, it is a feature of the present invention to provide an improved bonding of rubber or other elastomer to metal or plastic, which bonding must be maintained under extremely high pressure or high pressure and high temperature conditions.

It is another feature of the present invention to provide such an improved bonding in the parts of a blowout preventer.

It is still another feature of the present invention to provide such an improved bonding of parts in a blowout preventer by achieving a combination of a mechanical and a chemical bond.

SUMMARY OF THE INVENTION

The apparatus of a preferred embodiment of the present invention is a packer in a blowout preventer that includes a rubber or other elastomer component and either or both a plastic and a metal component that is bonded to the elastomer component. The interface of the elastomer component or part is molded during the molding of the part in its desired shape to include a plurality of integrally molded projecting rivets. Each rivet preferably has an enlarged end. As with metal rivets, the size and shape of the rubber rivets have a general proportionality among the rivet head, the rivet diameter, and the thickness of the part through which the rivet passes as described in common reference books such as Machinery's Handbook, 23rd Edition, Edited by Henry H. Ryffel, except the dimensions are less restrictive because one end of an elastomeric rivet does not require forging in that the rivet is molded into a single piece. As the overall molded piece cools, the elastomeric rivet shrinks and forms a tightly "riveted" connection that maintains the bond line of the main adhesive junction under compression.

The mating plastic or metal interface with the elastomer includes compatible accommodating rivet holes into which the rivets are molded. Before that assembly, however, at least one of the interfacing surfaces is coated with a suitable so-called bonding line or bonding agent material, including the rivet hole surfaces. For ease of molding, flat head rivets are preferred although the flexibility of the molding process allows a wide variety of rivet bodies and heads for attaching and maintaining connections between metal/plastic and elastomeric materials.

The parts of the final assembly produced by this process, therefore, are both mechanically and chemically bonded together.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the drawings illustrate only preferred embodiments of the invention and is therefore not to be considered limiting of its scope as the invention may admit to other equally effective embodiments.

In the drawings:

FIG. 1 is an exploded pictorial view of upper block carrier assembly of a shear ram in a blowout preventer, a typical application for the present invention.

FIG. 2 is a cross-sectional view of a shear ram following the severing of a pipe, showing a typical application of the present invention.

FIG. 3 is a close-up view of a portion of the shear ram shown in FIG. 2.

DESCRIPTION OF THE PREFERRED EMBODIMENTS

Figure 4:
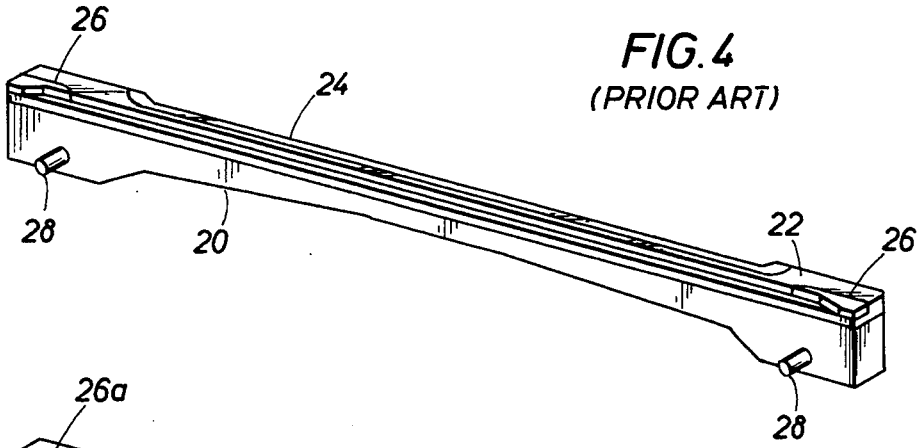
FIG. 4 (PRIOR ART)
FIG. 4 is a pictorial view of a T-seal used in a shear ram in accordance with the prior art.
Figure 5:
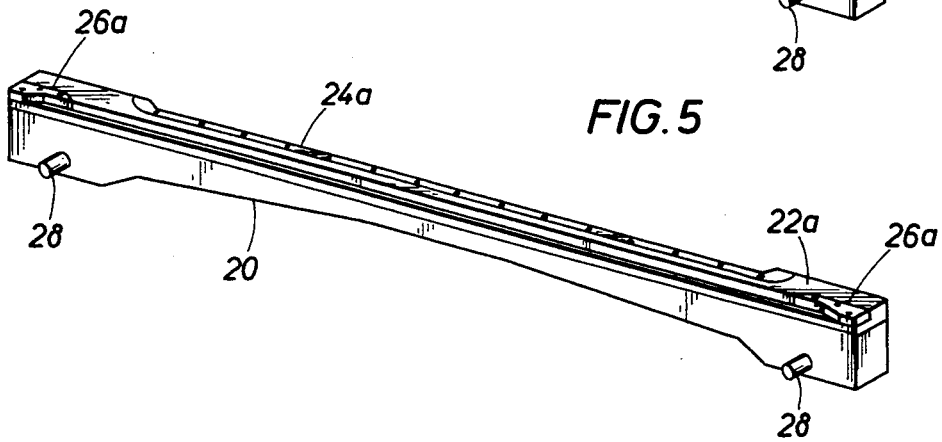
FIG. 5 is a pictorial view of a T-seal used in a shear ram in accordance with the present invention.

The bonding of the elastomers, typically rubberized products, to metal or other material substrates, typically plastic and metal, has been traditionally facilitated by the use of chemical adhesive systems. The designing of a bonded assembly with elastomeric materials is predicated on the use of the assembly, its operating environment and other factors. Depending on the adhesive selected in a particular circumstance, a primer may also be used. Further, chemical and/or mechanical means are often employed to clean and otherwise prepare the surfaces to be bonded. The adhesive materials can be applied in a number of different ways, including the use of a brush, sprayer, dipping process, or a roller. Controlled temperature and a clean environment during the application and curing stages are also important to assure that the surfaces and the bonding materials remain uncontaminated. However, as noted above, regardless of the process or the materials employed, there are circumstances where a mechanical securement in addition to chemical bonding results in a more satisfactory assembly. One such application involves the bonding of the elastomer or rubber parts in a blowout preventer.

Now referring to FIG. 1, an upper block carrier assembly 8 is shown having a packer comprising basically two elastomer or rubber assemblies, namely, upper seal 10 and lateral T-seal 12. The other major parts illustrated in FIG. 1 are upper blade carrier 14 and upper shear blade 16. The other parts are not further identified, but the assembly of these parts generally utilizes bolts and is well-known in the art. As assembled, upper blade carrier assembly 8 appears generally in cross section in FIG. 2.

In operation, upper blade carrier assembly 8 is employed with a lower blade carrier assembly 18. The shearing operation performed by these two assemblies utilizes a twin V-blade arrangement with sharp rake angles to crimp, tension, and shear a drill pipe. Shearing pipe is usually done in adverse conditions and at a recommended maximum operating pressure on the order of 3,000 psi. Repeatable shearing operations are required of the shear ram components.

Figure 6:
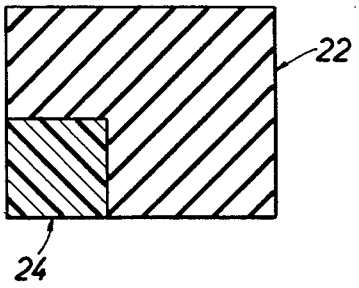
FIG. 6 (PRIOR ART)
FIG. 6 is an end cross-sectional view of the T-seal shown in FIG. 4.
Figure 8:
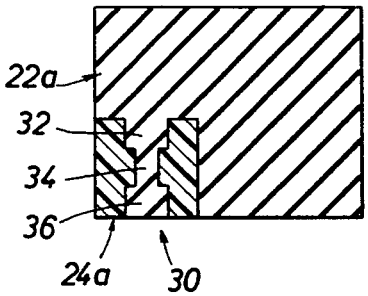
FIG. 8 is an end cross-sectional view of the T-seal shown in FIG. 5.
Figure 7:
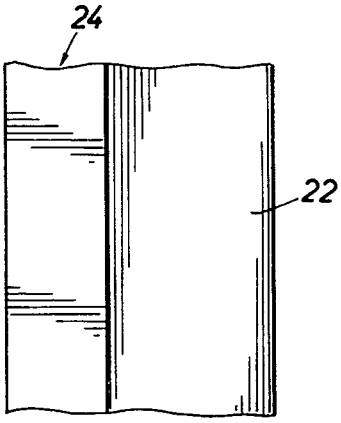
FIG. 7 (PRIOR ART)
FIG. 7 is a top cross-sectional view of a segment of the T-seal shown in FIG. 4.
Figure 9:
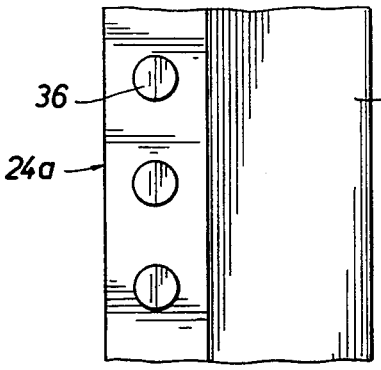
FIG. 9 is a top cross-sectional view of a segment of the T-seal shown in FIG. 5.

The lateral T-seal is a complex structure made up of two different types of nitrile rubber compounds for upper elastomer section 20 and lower elastomer T-section 22, respectively, nylon or other non-elastomer plastic central anti-extrusion bar 24 and end anti-extrusion pieces 26, and metal alignment pins 28. As shown in FIGS. 4, 6 and 7, all of the pieces have heretofore been bonded to each other using adhesive appropriate to the application. Bonding agents that have been preferably employed are Chemlock 205 and Chemlock 220, which are products of Lord Elastomer Products of Erie, Pennsylvania. Other equivalent bonding agents can also be used.

It has been discovered that security of the bonding is greatly improved over the use of a bonding agent alone by including integrally molded, projecting, generally round rivets 30 in lower elastomer T-section **22*a* when it is molded in its manufacture. Also, anti-extrusion bar 24*a* includes accommodating rivet holes for mating with rivets 30. A rivet 30 preferably includes an enlarged base 32 contiguous to the main body of section 22*a*, a narrow, reduced diameter center section 34, and an enlarged outer end section 36**. Thus, during assembly, after the matching surfaces have been appropriately coated with adhesive or other appropriate bonding line composition, but before the underlying elastomer and the bonding agent have completely cured, the components are assembled by pressing the parts together so that the elastomeric rivets press through the rivet holes. A preferred commercial compound for use as this bonding line is either Chemlock 205 or Chemlock 220. Thus, the bonding achieved is both chemical bonding along the bonding line interface between the elastomer and the other material and mechanical bonding, adding significant extra strength to the overall bond.

It should be noted that during the cooling or curing process, the elastomeric rivet shrinks and forms a tightly "riveted" connection with the other material of the junction. The shrinking of the rivet compresses the materials together and thereby enhances the adhesive bond line. In addition to providing a compressive load on the bond line, the elastomer rivet also provides an extra shear area that further strengthens the overall assembly of parts as the elastomer is distorted during operational loading.

Although the use of integrally molded rivets has been described in bonding rubber and nylon or other plastic together in the example, the use of such rivets in combination with appropriate bonding materials or adhesives is equally satisfactory with respect to bonding rubber or other elastomer to metal.

Figure 10:
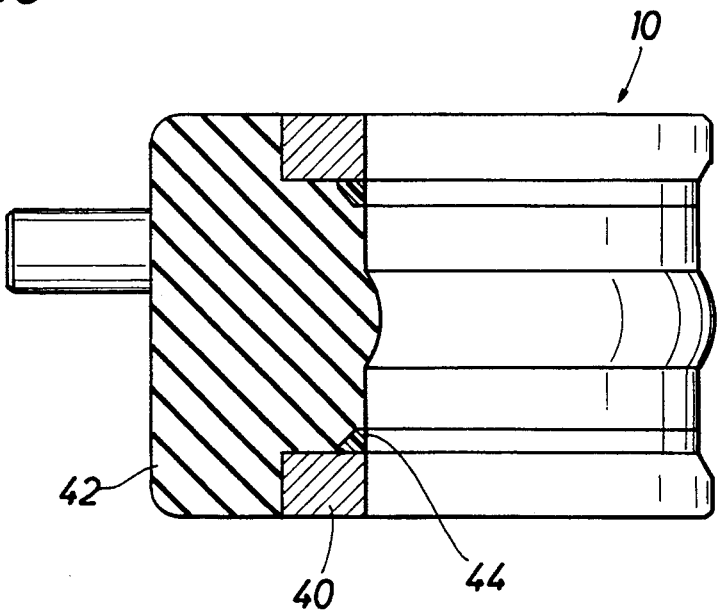
FIG. 10 is a partial view, some of which is in cross section, of a packer element used in a pipe ram.
Figure 11:
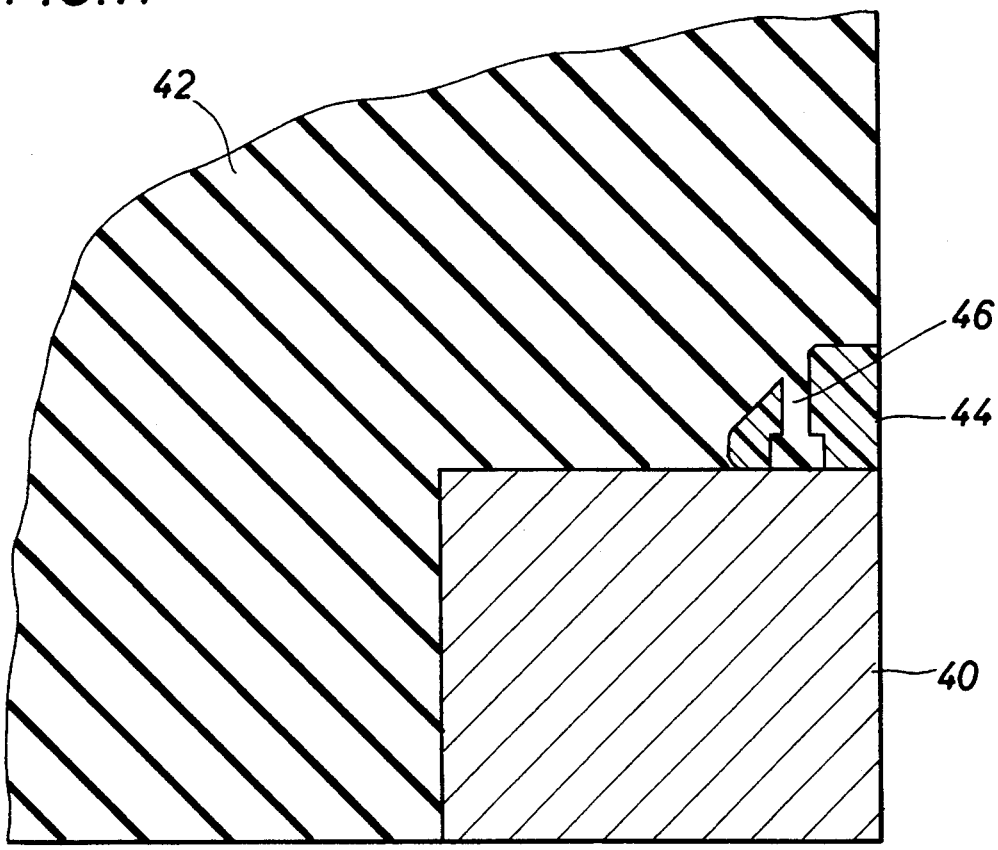
FIG. 11 is a close-up view of a portion of the packer element shown in FIG. 10.

Now referring to FIGS. 10 and 11, a portion of a packer element 10 employed in a pipe ram assembly includes a metal plate 40 adhered or bonded to elastomer 42. A plastic insert 44 is employed in an area at a corner between the elastomer and the metal plate that is chemically and mechanically bonded by the use of rivet 46. The purpose of this insert is explained more fully in U.S. Pat. No. 5,180,137, issued Jan. 19, 1993 in the names of Douglas W. Carlson, et al., which patent is commonly assigned herewith and incorporated by reference for all purposes. However, briefly, insert 44 is a non-elastomer, relatively rigid strip that is bonded to elastomer 42, preferably a nitrile rubber material, but is not bonded to metal plate 40. Because the interface surface between insert 44 and elastomer 42 is a relatively small area, the retention force by chemical bonding alone is greatly enhanced by the use of rivet 46, which not only enhances bonding in the manner previously described for rivets 30 above, but adds bonding strength in this case by significantly increasing the amount of surface area subject to coating with the bonding agent. Rivet 46 is similar to rivet 30 described above although, in this case, the body attached to the head has a uniform diameter dimension. Otherwise, the bonding accomplished by the use of the integral elastomer rivet structure is the same as discussed above.

The interface surface between elastomer 42 and metal plate 40 is much greater than the interface without the use of rivet 46 between elastomer 42 and insert 44. Therefore, although the bonding of elastomer 42 to metal plate 40 could be enhanced by the use of similar integral rubber rivets, it has not been necessary in this case.

The environment that has been described is the environment encountered by the nitrile rubber and other material complex parts of a typical blowout preventer. However, the invention can also be used in other applications, especially where the operating conditions are extremely severe and include high pressures and/or high temperatures.

While preferred embodiments of the invention have been described and illustrated and alternatives discussed, it will be understood that the invention is not limited thereto, since many modifications may be made and will become apparent to those skilled in the art.

What is claimed is:

1. The process for mechanically and chemically bonding a mating plastic or metal part of a blowout preventer packer to an elastomer part and to thereby maintain bonding under high pressure and high temperature conditions, which comprises molding the elastomer part into the desired shape including integrally molding a plurality of rivets in the elastomer part interface surface to prepare it for bonding to the plastic or metal part, forming the mating plastic or metal part with accommodating rivet holes for each of the elastomer rivets, coating the interface surfaces of the elastomer part including the rivet surfaces with a bonding composition for bonding the elastomer part with the matching plastic or metal part, and integrally molding the rivets into the rivet holes before the elastomer part and the bonding composition sets to accomplish both mechanical and chemical bonding of the elastomer part to the plastic or metal part to thereby cause compression of the bonding composition upon post-molding shrinking of the rivets.

2. The process for mechanically and chemically bonding in accordance with claim 1, and including molding each of the rivets to have an enlarged outer end and forming each of the rivet holes to have an accommodating shape for matingly receiving the rivets with the enlarged ends to thereby cause compression of the bonding composition upon post-molding shrinking of the rivets.

* * * * *